US008981289B2

(12) United States Patent
Kim et al.

(10) Patent No.: US 8,981,289 B2
(45) **Date of Patent: *Mar. 17, 2015**

(54) ULTRAVIOLET DIODE AND ATOMIC MASS ANALYSIS IONIZATION SOURCE COLLECTING DEVICE USING ULTRAVIOLET DIODE AND AN MCP

(75) Inventors: Seung Yong Kim, Daejeon (KR); Mo Yang, Daejeon (KR); Hyun Sik Kim, Daejeon (KP)

(73) Assignee: Korea Basic Science Institute, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/125,436

(22) PCT Filed: Dec. 16, 2011

(86) PCT No.: PCT/KR2011/009747

§ 371 (c)(1),
(2), (4) Date: Dec. 11, 2013

(87) PCT Pub. No.: WO2013/042829

PCT Pub. Date: Mar. 28, 2013

(65) Prior Publication Data

US 2014/0339423 A1 Nov. 20, 2014

(30) Foreign Application Priority Data

Sep. 20, 2011 (KR) ..... 10-2011-0094678

(51) Int. Cl.
*H01J 49/10* (2006.01)
*H01J 49/06* (2006.01)
(Continued)

(52) U.S. Cl.
CPC ..... *H01J 49/161* (2013.01); *H01J 49/0022* (2013.01); *H01J 49/08* (2013.01); *H01J 49/424* (2013.01)
USPC ..... 250/288; 250/281; 250/282; 250/292; 250/397; 29/428

(58) Field of Classification Search
CPC ..... H01J 49/06; H01J 49/0045; H01J 49/025
USPC ..... 250/288, 281, 282, 292, 397; 29/428
See application file for complete search history.

(56) References Cited

U.S. PATENT DOCUMENTS 6,239,549 B1 * 5/2001 Laprade ..... 313/533
2014/0124662 A1 * 5/2014 Yang et al. ..... 250/288
(Continued)

FOREIGN PATENT DOCUMENTS

JP 11-040069 A 2/1999
KR 10-2010-0112136 A 10/2010

*Primary Examiner* — Nikita Wells
(74) *Attorney, Agent, or Firm* — Rabin & Berdo, P.C.

(57) ABSTRACT

The present invention relates to an ultraviolet diode and an atomic mass analysis ionization source collecting device using an MCP. In the manufacturing of a portable atomic mass analyzer, an object of the present invention is to use an MCP electron multiplier plate, whereby ultraviolet photons emitted from an ultraviolet diode are irradiated on a front surface plate of the MCP electron multiplier plate to induce primary electrons, an amplified electron beam is collected from the electrons, and an electron beam is generated at a low temperature and low power and having a discharge time that is accurately controlled. The atomic mass analysis ionization source collecting device using an ultraviolet diode and an MCP according to the present invention comprises: an ultraviolet diode emitting ultraviolet rays by means of supplied power; an MCP electron multiplier plate inducing and amplifying primary electron discharge from ultraviolet photons from the ultraviolet diode, and collecting a large amount of electron beams from an MCP reverse surface plate; an electron condenser lens condensing the electron beam amplified through the MCP electron multiplier plate; an ion trap atomic mass separator ionizing gas sample molecules by means of an electron beam injected through the electron condenser lens; and an ion detector performing detection of ions separated from the ion trap atomic mass separator, by means of an atomic mass spectrum.

6 Claims, 2 Drawing Sheets

(51) Int. Cl.

| | |
|---|---|
| ***H01J 49/26*** | (2006.01) |
| ***H01J 49/16*** | (2006.01) |
| ***H01J 49/00*** | (2006.01) |
| ***H01J 49/08*** | (2006.01) |
| ***H01J 49/42*** | (2006.01) |

(56) References Cited

U.S. PATENT DOCUMENTS

| | | | | |
|---|---|---|---|---|
| 2014/0151549 | A1* | 6/2014 | Steiner et al. | 250/288 |
| 2014/0158880 | A1* | 6/2014 | Yang et al. | 250/282 |

* cited by examiner

ULTRAVIOLET DIODE AND ATOMIC MASS ANALYSIS IONIZATION SOURCE COLLECTING DEVICE USING ULTRAVIOLET DIODE AND AN MCP

TECHNICAL FIELD

The present invention relates to an electron gun for ionizing gaseous molecules in a mass analyzer and, more particularly, to a device for acquiring an ion source of a mass analyzer using an ultraviolet (UV) diode and a micro-channel plate (MCP), in which cold electrons are produced at room temperature using the UV diode and an MCP electron multiplier plate, and are applied to the mass analyzer, without using a thermionic emission method based on a high temperature and a high current.

BACKGROUND ART

In general, to separate molecular ions to analyze components according to the masses of the ions in a mass analyzer, first, a process of ionizing gaseous molecules is required.

A method of bombarding the gaseous molecules with an electron beam to produce the molecular ions is most frequently used. To produce the electron beam, a device for heating a filament at a high temperature to induce thermionic emission is most widely used.

The filament can be heated at a high temperature by causing a high current to flow to a high-temperature metal such as tungsten or rhenium. However, due to high power consumption, battery power is rapidly consumed in a portable mass analyzer, and a reaction to electron emission caused by a rise to a high temperature is slow. As such, it is difficult to control the electron emission in a mass analyzer that is suitable to produce a continuous output electron beam and requires pulse ionization within a short time.

DISCLOSURE

Technical Problem

Accordingly, the present invention is directed to a device for acquiring an ion source of a mass analyzer using an ultraviolet (UV) diode and a micro-channel plate (MCP), in which an MCP electron multiplier plate is used to produce a portable mass analyzer, UV photons emitted from the UV diode are applied to the front of the MCP electron multiplier plate and induce initial electron emission, the emitted electrons are amplified into an electron beam, and the electron beam in which an emission time thereof is accurately adjusted with a low temperature and low power is obtained.

Technical Solution

According to an aspect of the present invention, there is provided a device for acquiring an ion source of a mass analyzer using an ultraviolet (UV) diode and a micro-channel plate (MCP), in which electrons generated by UV photons are amplified into an electron beam using the UV diode and the MCP, the electron beam ionizes gaseous sample molecules to produce ions, and the ions are detected. The device includes: the UV diode emitting the UV using supplied power; an MCP electron multiplier plate causing the UV photons from the UV diode to induce initial electron emission and amplifying the emitted electrons into a large quantity of electron beam at a rear plate thereof; an electron beam focusing lens focusing the electron beam amplified through the MCP electron multiplier plate; an ion trap mass separator ionizing the gaseous sample molecules to produce ions using the electron beam injected by the electron beam focusing lens and trapping the ions in a given space; and an ion detector detecting the ions produced by the ion trap mass separator based on a mass spectrum.

Advantageous Effects

As described above, the device for acquiring an ion source of a mass analyzer using an ultraviolet (UV) diode and a micro-channel plate (MCP) can produce the electron beam for ionizing the gaseous sample molecules at a low temperature without using a high temperature and a high current, reduce a size, weight, and battery power consumption when applied to a small mass analyzer because only a necessary quantity of electron beam is produced at a necessary time, be applied to a portable mass analyzer. Further, a thin electron beam is emitted, and is thus focused with relative ease.

MODE FOR INVENTION

Hereinafter, exemplary embodiments of the present invention will be described in detail below with reference to the attached drawings. While the present invention is shown and described in connection with exemplary embodiments thereof, it will be apparent to those skilled in the art that various modifications can be made without departing from the spirit and scope of the invention.

A device for acquiring an ion source of a mass analyzer using an ultraviolet (UV) diode and a micro-channel plate (MCP) in accordance with an embodiment of the present invention will be described below in detail with reference to the attached drawings.

Figure 1:
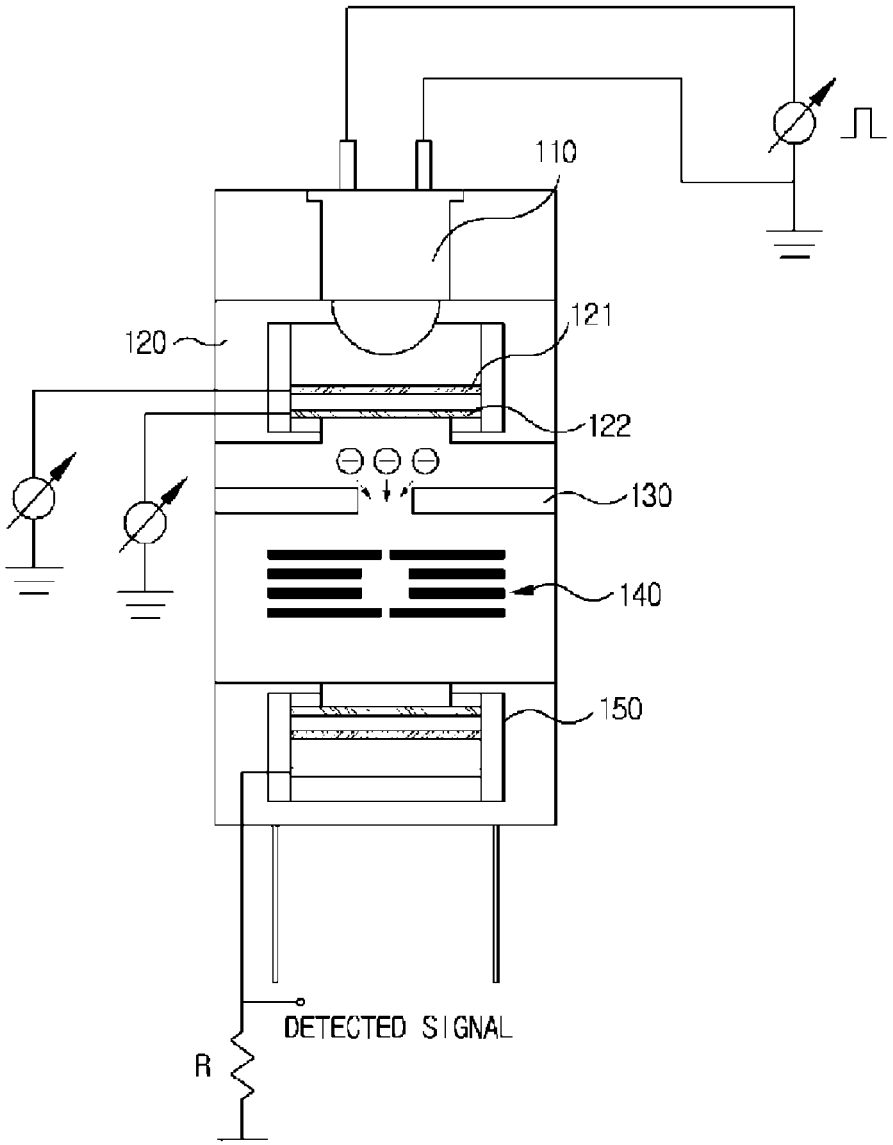
FIG. 1 shows an overall configuration of a device for acquiring an ion source of a mass analyzer using an ultraviolet (UV) diode and a micro-channel plate (MCP) in accordance with an embodiment of the present invention.

FIG. 1 shows a configuration of a device for acquiring an ion source of a mass analyzer using a UV diode and an MCP in accordance with an embodiment of the present invention. The device includes a UV diode 110 emitting UV using supplied power, an MCP electron multiplier plate 120 causing the UV photons from the UV diode 110 to induce initial electron emission and amplifying the emitted electrons into a large quantity of electron beam at a rear plate thereof, an electron beam focusing lens 130 focusing the electron beam amplified when passing through the MCP electron multiplier plate 120, an ion trap mass separator 140 ionizing gaseous sample molecules to produce ions using the electron beam injected by the electron beam focusing lens 130, and an ion detector 150 detecting the ions produced by the ion trap mass separator 140 based on a mass spectrum.

Each component of the mass analyzer is operated in a vacuum chamber having a pressure of $10^{-4}$ to $10^{-10}$ Torr.

Here, the MCP electron multiplier plate 120 is configured so that the UV photons emitted from the UV diode 110 is applied to a front plate 121 thereof, and the electrons generated by the UV photons applied to the front plate 121 are amplified at a rear plate 122 thereof.

An operation of the ion source acquiring device configured in this way will be described below in greater detail with reference to FIGS. 1 and 2.

First, an MCP module causes the UV photons to induce the initial electron emission, and amplifies the emitted electrons into the electron beam. After the electron beam is focused by the electron beam focusing lens, the ion trap mass separator ionizes the gaseous sample molecules to produce ions, and the produced ions are detected by the ion detector.

FIG. 1 shows an overall configuration of a device for acquiring an ion source of a mass analyzer using a UV diode and an MCP in accordance with an embodiment of the present invention. FIG. 2 shows a configuration of an MCP module shown in FIG. 1. The UV diode 110 applies a pulse signal of supplied power for emitting the UV based on the pulse signal of supplied power.

The UV emitted from the UV diode 110 is applied to the front plate 121 of the MCP electron multiplier plate, and induces the initial electron emission at the front plate 121.

The initial electrons emitted in quantity by the UV are amplified into the electron beam when passing through the front and rear plates 121 and 122, and the electron beam amplified at the rear plate 122 can be obtained.

Figure 2:
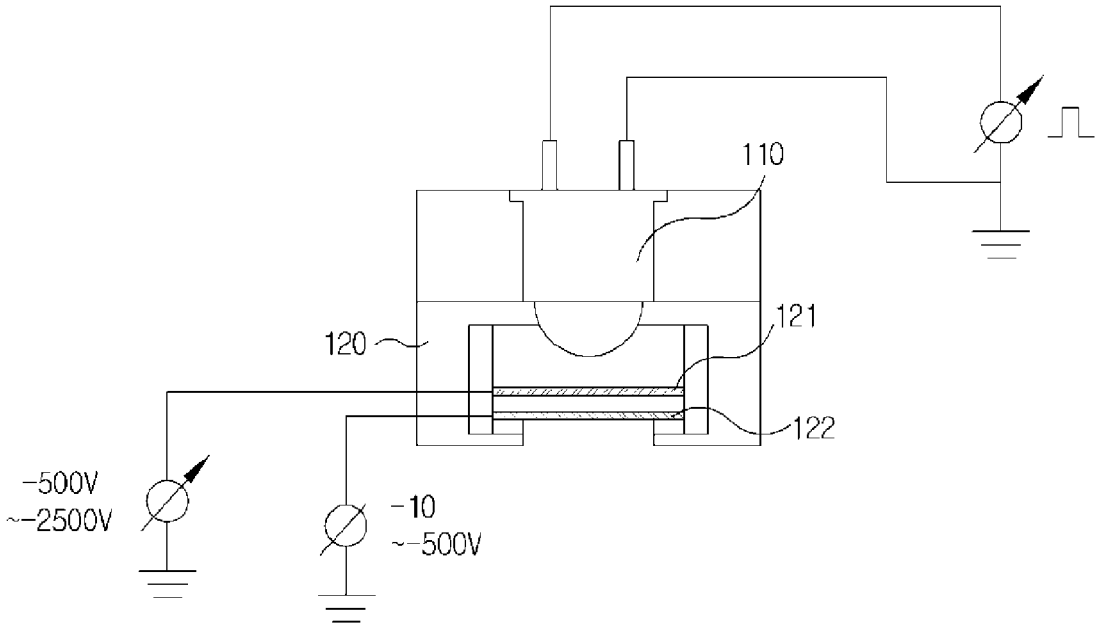
FIG. 2 shows a configuration of an MCP module shown in FIG. 1.

As shown in FIG. 2, a negative voltage of −500 V to −2500 V is applied to the front plate 121, and a negative voltage of −10 V to −500 V is applied to the rear plate 122. Thereby, the electrons generated by the UV are highly amplified.

The electron beam amplified by the MCP electron multiplier plate 120 is focused in one direction by the electron beam focusing lens 130, and is injected into the ion trap mass separator 140. The electron beam ionizes the gaseous sample molecules.

Here, the ionization is adjusted by a UV emission time and UV intensity of the UV diode 110. In detail, the ionization is adjusted by an on/off pulse signal of the power driving the UV diode 110. When the on pulse signal is applied for a long time, a large quantity of UV is emitted. When the on pulse signal is applied for a short time, a small quantity of UV is emitted.

Further, the UV intensity of the UV diode 110 is adjusted by a value of current flowing to the UV diode. Thereby, a quantity of the emitted UV photons is adjusted. Thus, it is possible to accurately momentarily obtain an electron current which the mass analyzer requires for gas ionization.

To focus the UV emitted from the MCP module 110 or 120, a negative voltage is applied to the electron beam focusing lens 130, and is higher than that applied to the rear plate 122 of the MCP electron multiplier plate 120.

The ion trap mass separator 140 ionizes the gaseous sample molecules to produce ions using the electron beam passing through the electron beam focusing lens 130. The ion detector 150 detects the ions produced by the ion trap mass separator 140, and the detected ions are converted into signals by a principle of the ion trap mass separator.

In this way, the device for acquiring an ion source of a mass analyzer using a UV diode and an MCP in accordance with an embodiment of the present invention can be applied to apparatuses using a low-temperature electron gun or beam required for a portable compact device, a low-power device, or a low-temperature device.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A device for acquiring an ion source of a mass analyzer using an ultraviolet (UV) diode and a micro-channel plate (MCP), in which applied UV photons induce initial electron emission in a high vacuum state in a vacuum chamber of the mass analyzer, the emitted electrons are amplified into an electron beam, the electron beam converts gaseous sample molecules into ions, and the ions are detected, the device comprising:

the UV diode emitting the UV in the vacuum chamber of the mass analyzer;

an MCP electron multiplier plate that causes the UV photons from the UV diode to induce the initial electron emission and amplifies the emitted electrons into a large quantity of electron beam at a rear plate thereof;

an electron beam focusing lens focusing the electron beam amplified through the MCP electron multiplier plate;

an ion trap mass separator ionizing the gaseous sample molecules to produce ions using the electron beam injected by the electron beam focusing lens and trapping the ions in a given space; and an ion detector detecting the ions produced by the ion trap mass separator based on a mass spectrum.

2. The device of claim 1, wherein the UV diode adjusts a UV emission time and UV intensity according to an on/off pulse signal thereof.

3. The device of claim 1, wherein the MCP electron multiplier plate is configured so that the UV photons emitted in quantity from the UV diode is applied to a front plate thereof, and induces the initial electron emission in quantity, and the emitted electrons are amplified into the electron beam having a high current at the rear plate thereof.

4. The device of claim 1, wherein the MCP electron multiplier plate is configured so that a voltage of −500 V to −2500 V is applied to a front plate thereof, and a voltage of −10 V to −500 V is applied to the rear plate thereof.

5. The device of claim 1, wherein the electron beam focusing lens has an applied voltage higher than a negative voltage applied to the rear plate of the MCP electron multiplier plate.

6. The device of claim 1, wherein each component is provided in the vacuum chamber having a pressure of $10^{-4}$ to $10^{-10}$ Torr.

* * * * *